US006243913B1

(12) United States Patent
Frank et al.

(10) Patent No.: US 6,243,913 B1
(45) Date of Patent: Jun. 12, 2001

(54) CLEANING DEVICE

(75) Inventors: Juergen Frank, Kirchberg; Eugen Ernst, Leutenbach; Alfred Losansky, Waiblingen, all of (DE)

(73) Assignee: Alfred Karcher GmbH & Co., Winnenden (DE)

( * ) Notice: Subject to any disclaimer, the term of this patent is extended or adjusted under 35 U.S.C. 154(b) by 0 days.

(21) Appl. No.: 09/557,843

(22) Filed: Apr. 26, 2000

Related U.S. Application Data

(63) Continuation of application No. PCT/EP98/06773, filed on Oct. 24, 1998.

(30) Foreign Application Priority Data

Oct. 27, 1997 (DE) ..... 197 47 318

(51) Int. Cl.[7] ..... A47L 7/00
(52) U.S. Cl. ..... 15/320; 15/321; 15/339
(58) Field of Search ..... 15/320, 321, 339

(56) References Cited

U.S. PATENT DOCUMENTS

| | | | | |
|---|---|---|---|---|
| 3,262,146 | | 7/1966 | Hays . | |
| 3,343,199 | * | 9/1967 | Nolte | 15/321 X |
| 4,651,380 | * | 3/1987 | Ogden | 15/321 |
| 4,934,017 | * | 6/1990 | Kent | 15/321 |
| 5,146,647 | | 9/1992 | Blase et al. . | |
| 5,237,719 | * | 8/1993 | Dwyer et al. | 15/321 |
| 5,301,386 | * | 4/1994 | Thomas et al. | 15/321 |
| 5,500,977 | | 3/1996 | McAllise et al. . | |
| 5,715,568 | * | 2/1998 | Berfield | 15/321 X |
| 5,890,258 | * | 4/1999 | Lee | 15/339 X |

FOREIGN PATENT DOCUMENTS

| | | |
|---|---|---|
| 2 166 158 | 7/1973 | (DE) . |
| 84 28 799 | 2/1985 | (DE) . |
| 91 14 613 | 4/1992 | (DE) . |
| 7703126 | 9/1978 | (NL) . |
| WO 88/01146 | 2/1988 | (WO) . |

* cited by examiner

*Primary Examiner*—Chris K. Moore
(74) *Attorney, Agent, or Firm*—Barry R. Lipsitz

(57) ABSTRACT

In order to further develop a cleaning device comprising a cleaning liquid tank and a dirty liquid tank as well as a pump in flow communication with the cleaning liquid tank for spraying a surface to be cleaned and a suction unit for receiving the sprayed cleaning liquid and transferring it into the dirty liquid tank in such a manner that it is more service-friendly and less noisy it is suggested that the pump and the suction unit be held in a separate housing which can be introduced into a frame of the cleaning device in the form of an insert.

12 Claims, 4 Drawing Sheets

Figure 1:
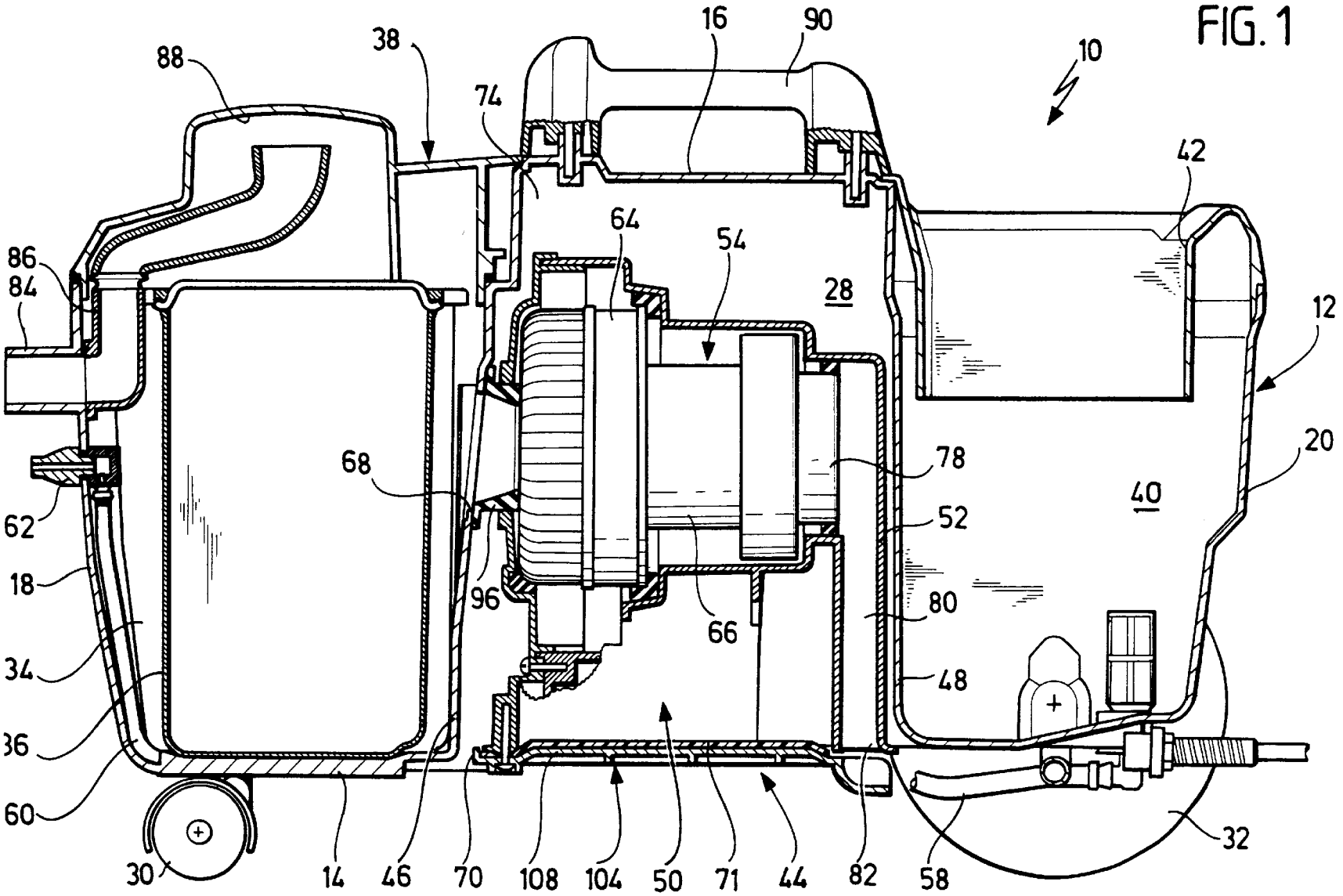

10
12
20
32
42
40
58
78
52
80
48
82
28
90
44
16
54
66
71
50
64
104
108
74
96
70
38
68
46
14
88
30
86
84
62
18
34
36
60

CLEANING DEVICE

The present disclosure is a continuation of the subject matter disclosed in International Application No. PCT/EP98/06773 (WO 99/21470) of Oct. 24, 1998, the entire specification of which is incorporated herein by reference.

The invention relates to a cleaning device comprising a cleaning liquid tank and a dirty liquid tank as well as a pump in flow communication with the cleaning liquid tank for spraying a surface to be cleaned and a suction unit for receiving the sprayed cleaning liquid and transferring it into the dirty liquid tank, wherein the pump and the suction unit are held in a separate housing which can be introduced into a frame of the cleaning device in the form of an insert.

Cleaning devices of this type are used, for example, in the form of spray extraction devices for the cleaning of carpeting and upholstered furniture. In this respect, a jet of cleaning liquid is directed against the surface to be cleaned by means of the pump, and subsequently the cleaning liquid is drawn in together with the dissolved dirt with the aid of the suction unit and transferred into the dirty liquid tank.

In general, the pump and the suction unit are each driven by an electric motor and are held on a frame of the cleaning device by means of screws. During maintenance and repair work it is necessary to unscrew the suction unit and, possibly, the pump as well from the frame and, in addition, to disconnect the electrical connection and control cables for the electric motors from the frame. This disconnection results at the same time in the pump being separated from the suction unit. Such a dismantling may be done only by qualified skilled personnel. Since the cleaning devices are often hired out by dry cleaning companies, maintenance and repair work of this type is particularly inconvenient since it entails considerable time and thus also substantial costs for the hire company since the device is not available for hiring to further customers during the maintenance and/or repair of the electrical components.

An additional disadvantage of customary cleaning devices of the type specified at the outset is the fact that they are linked to a considerable generation of noise. A mixture of air and dirty liquid is drawn in by the suction unit, and while the dirty liquid is being transferred to the dirty liquid tank the air drawn in is blown out into the atmosphere. This entails a blowing out noise which, normally, can be clearly heard and in combination with the motor noises of the pump and the suction unit results in a substantial generation of noise.

It is already known from NL-A-7 703 126 and U.S. Pat. No. 5,146,647 to arrange the pump and the suction unit in a housing which can be introduced into a frame of the cleaning device in the form of an insert. The cleaning liquid tank and the dirty liquid tank each have an access opening for filling and emptying, respectively. In NL-A-7 703 126 it is suggested that the housing accommodating the pump and the suction unit be inserted from above into an intermediate space between the two tanks. In U.S. Pat. No. 5,146,647 it is suggested that the housing be positioned above the two tanks on the frame of the cleaning device. Consequently, not only with the cleaning device known from NL-A-7 703 126 but also with the cleaning device described in U.S. Pat. No. 5,146,647 there is the risk of cleaning or dirty liquid coming into contact with the flow-guiding parts of the pump and/or the suction unit customarily driven be electric motors and so this can result in an interruption of the operation of the cleaning device.

The object of the present invention is to further develop a cleaning device of the generic type in such a manner that it is more service-friendly and less noisy and has a particularly high degree of operational safety.

This object is accomplished in accordance with the invention, in a cleaning device of the type specified at the outset, in that the-housing accommodating the pump and the suction unit can be introduced into the frame on the underside of the frame facing away from the access openings. In this way, it is ensured that the access for the pump and the suction unit is spatially separated from the access for the cleaning liquid tank and the dirty liquid tank. Whereas the housing accommodating the pump and the suction unit can be introduced into the frame on the underside of the frame facing away from the access openings, the access to the cleaning liquid tank and the dirty liquid tank is on the upper side of the frame facing away from the floor surface to be cleaned. As a result, contact with the cleaning liquid or the dirty liquid is avoided during the assembly of the pump and the suction unit which are normally driven by electric motors. This means a considerable increase in the operational safety of the inventive cleaning device.

The pump and the suction unit are encapsulated in a housing which can be separated from the frame of the cleaning device as a constructional unit. As a result, the maintenance and the repair of the cleaning device, like its production, are considerably simplified. For example, it is merely necessary, when the suction unit is out of action, to remove the housing configured as a constructional unit in the shape of an insert from the frame together with the suction unit and the pump and replace this with a substitute housing with a new suction unit and new pump. The removal and the introduction of the housing is very simple and can, therefore, also be done by non-skilled personnel. Particularly in the case of hire equipment, the time necessary for the maintenance and repair can, in this way, be kept very slight and as a result the costs incurred for the maintenance and repair of the cleaning device can be reduced.

The arrangement of the pump and the suction unit in a separate housing results, in addition, in a reduction in the noise of the cleaning device since the motor noises of the pump and the suction unit are not transmitted directly to the frame of the cleaning device but, first of all, to the housing surrounding them which can be introduced into the frame of the cleaning device in the form of an insert. The transfer of noise from the pump and the suction unit to the frame of the cleaning device and from this to the surroundings is therefore diminished.

It is particularly advantageous when the housing forms a flame-resistant plastic casing for the pump and the suction unit. As a result, the risk of an accident is clearly reduced since the components of the cleaning device which are customarily driven by electric motors and heat up during operation are separated by the flame-resistant plastic casing from the remaining components of the cleaning device.

It is of advantage when the housing forms a non-inflammable plastic casing for the pump and the suction unit.

A particularly good service-friendly operation can be achieved in that the housing accommodating the pump and the suction unit can be releasably connected to the frame, in particular, screwed to it. If the pump or the suction unit are intended to be exchanged for maintenance and/or repair work, only a few screws need by loosened in order to remove the housing with pump and suction unit designed as an insert from the frame of the cleaning device. Such an activity can also be carried out by a lay person who subsequently sends the insert removed for maintenance and/or repair, for example, to the producer of the cleaning device and inserts a replacement insert into the frame of the cleaning device and screws it thereto so that the cleaning device can be put into operation again after a short time.

During operation of the cleaning device, a mixture of air and dirty water is drawn in by the suction unit. In the dirty liquid tank, a separation of the entrained air from the dirty water normally takes place but it cannot be precluded with certainty that dirty water will reach the area of the suction unit with the air drawn in. In a particularly advantageous design of the cleaning device it is therefore provided for the housing to comprise a suction chamber for accommodating the suction unit as well as a pump chamber for accommodating the pump. As a result, the pump can be kept spatially separated from the suction unit in the housing so that it is ensured that the pump, in particular, its drive motor does not come into contact with the dirty water reaching the area of the suction unit.

It is favorable when the pump chamber is accessible independently of the suction chamber. For example, it may be provided for the pump to form an insert in the housing which can, again, be introduced into the frame of the cleaning device as an insert. The access to the pump chamber may be brought about via a first cover of the housing while a second cover is provided for the suction chamber.

The suction unit is customarily in flow communication with the dirty liquid tank via a suction opening and with the surroundings via an outlet opening so that the air drawn in from the dirty liquid tank can be passed to the surroundings. It is particularly advantageous when the outlet opening is arranged on the underside of the frame. The outlet opening represents not only an outlet for the air drawn in but it also forms, in addition, a noise exit opening. In the advantageous development, this noise exit opening is directed downwards, i.e. towards the floor surface to be cleaned. The results in a reduced generation of noise of the cleaning device.

It is particularly advantageous when the flow communication between suction unit and outlet opening has a deflection for the flow of air. The air drawn in is thus not guided in a straight line from the suction unit to the outlet opening but the suction unit is connected to the outlet opening via a curved flow channel. Such a curvature of deflection causes a not inconsiderable dampening of the noises exiting from the outlet opening. The flow channel can, for example, have a curvature through about 90° or, in particular, approximately 180°; a discharge air guidance with several deflections is particularly advantageous.

In a particularly preferred embodiment of the inventive cleaning device it is provided for the flow communication between suction unit and outlet opening to be brought about via a sound-insulating space. It may, for example, be provided for the outlet opening to be arranged on the housing designed as an insert, wherein an intermediate space is provided within the housing which forms at least part of the flow communication between suction unit and outlet opening. The intermediate space hereby serves as noise-insulating space, in which a superposition of the noise waves resulting during operation of the suction unit occurs, as a result of which the noises exiting from the outlet opening are considerably diminished.

It is of advantage when a sound-insulating material is arranged in the sound-insulating space, as a result of which the operating noises of the inventive cleaning device are additionally reduced.

In order to limit the development of heat of the drive motor used in the suction unit, this is customarily cooled by the drawn-in air of the suction unit. However, this involves a proneness to malfunction as dirty liquid drawn in by the suction unit with the flow of air can come into contact with the drive motor, which is mostly driven by electricity, and cause a short circuit. In an advantageous development of the inventive cleaning device it is therefore provided for the suction unit to comprise a ventilating fan for cooling the drive motor of the suction unit, the fan being in flow communication with a cooling air opening preferably arranged on the underside of the frame via a cooling air channel. For the cooling of the drive motor, a ventilating fan is thus used, to which cooling air is supplied via a separate cooling air channel. The cooling air does not come into contact with the drawn-in air of the suction unit. The cooling air is drawn in on the underside of the frame facing a floor surface to be cleaned. This results in a further reduction in the noise of the cleaning device since the cooling air opening also represents a noise exit opening which, in the present case, is however directed onto the floor surface to be cleaned, i.e. normally onto carpeting.

Figure 2:
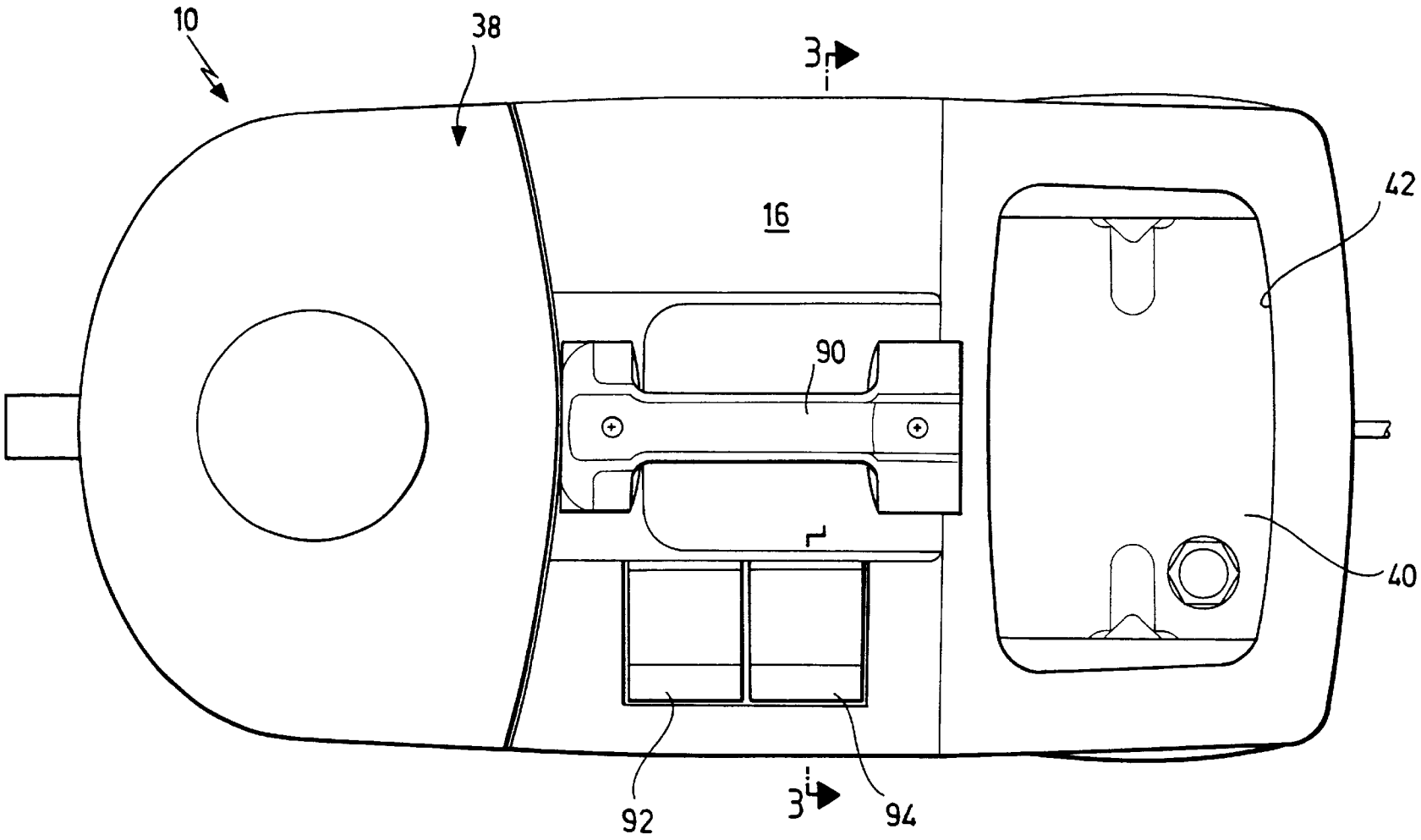
Figure 3:
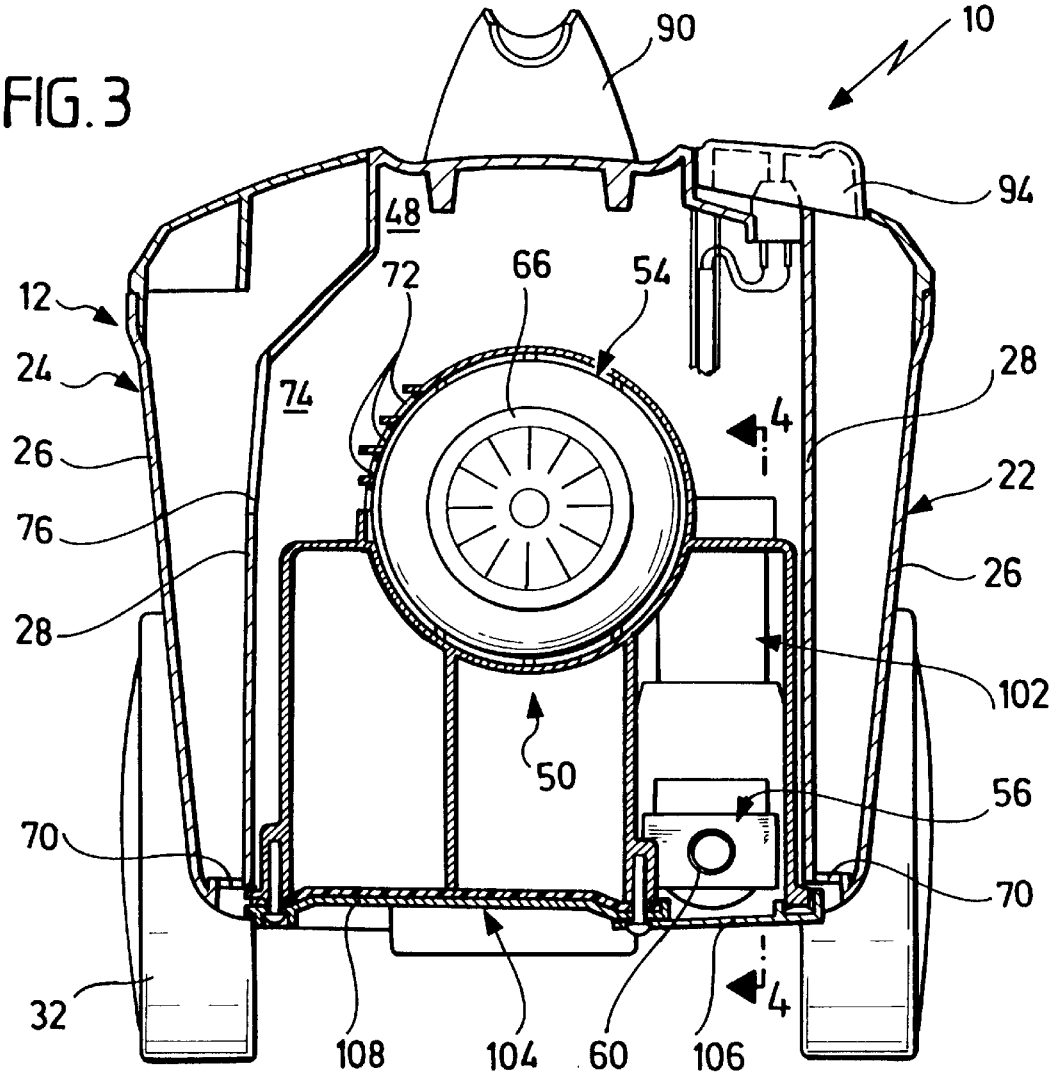
Figure 4:
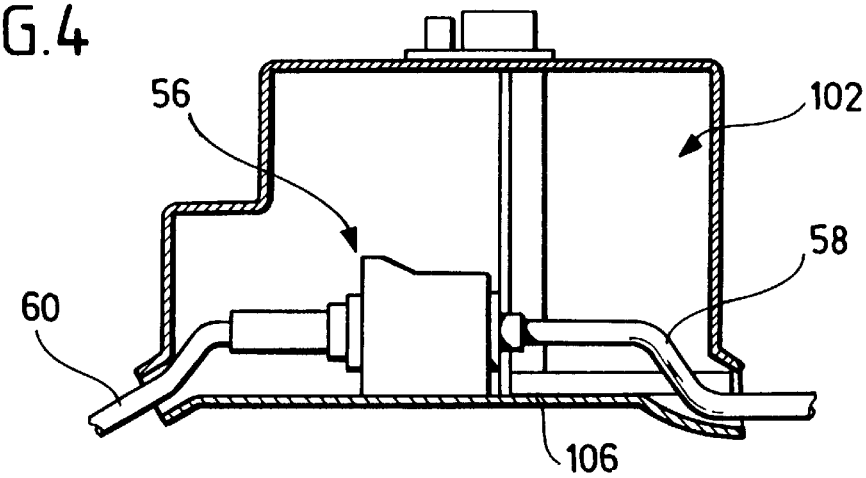

The following description of a preferred embodiment of the invention serves to explain the invention in greater detail in conjunction with the drawings. These show:

FIG. 1: a schematic sectional illustration in longitudinal direction of a cleaning device;

FIG. 2: a plan view of the cleaning device;

FIG. 3: a sectional illustration along line 3—3 in FIG. 2;

FIG. 4: a sectional illustration along line 4—4 in FIG. 3 and

Figure 5:
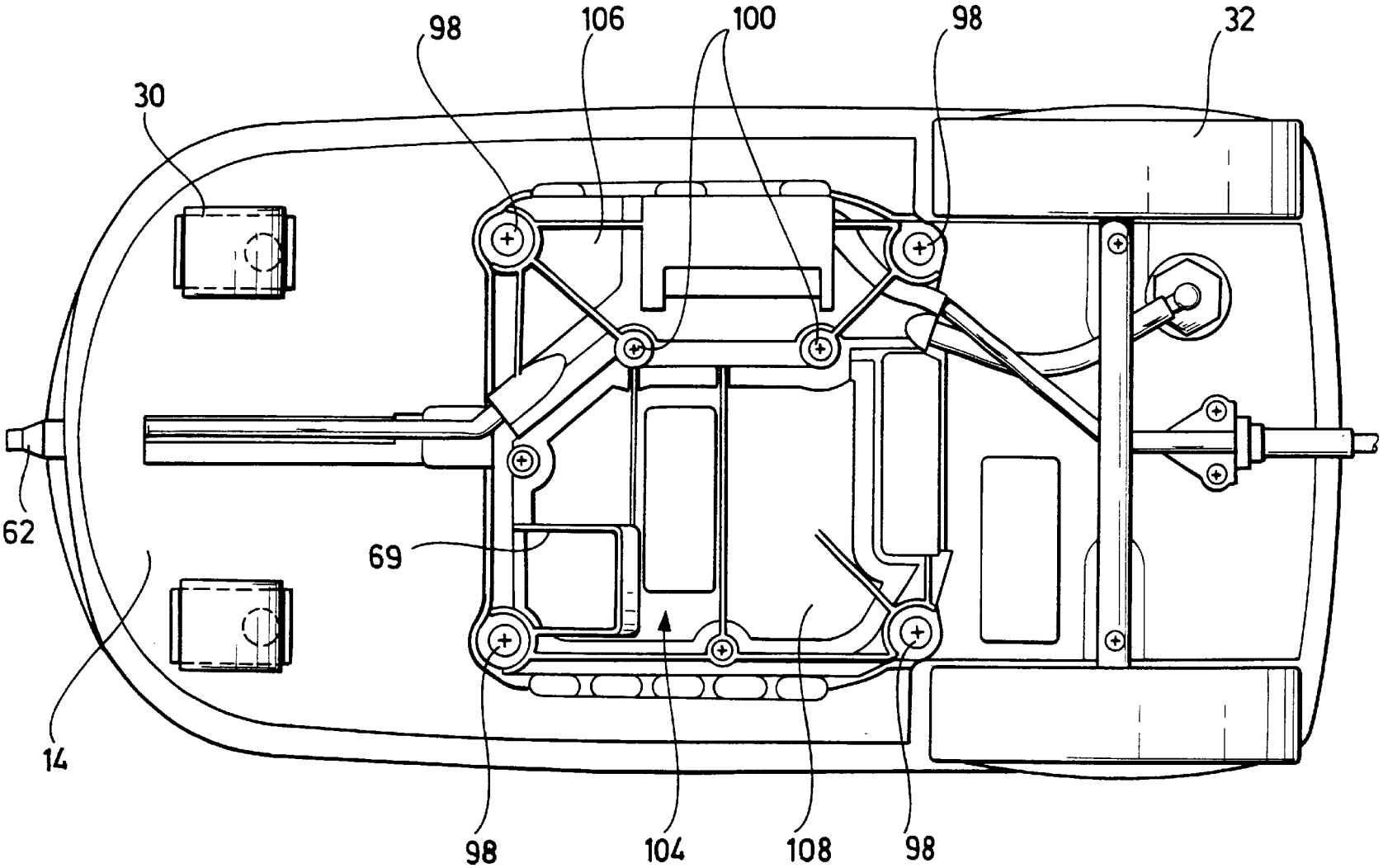

FIG. 5: a view of the cleaning device from below.

A portable cleaning device provided as a whole with the reference numeral 10 is illustrated in the drawings with a frame 12 designed as a chassis which is essentially of a parallelepiped design and comprises an underside 14, an upper side 16, a front side 18 and a rear side 20 as well as longitudinal sides 22 and 24 of a double-walled design. The latter each have an outer wall 26 and an inner wall 28, as is clear from FIG. 3.

Front wheels 30 as well as rear wheels 32 are rotatably mounted on the underside 14 of the frame 12. The area of the frame 12 adjacent the front side 18 is designed as a tank receiving means 34 which is accessible from the upper side 16, accommodates a dirty liquid tank 36 and is covered by a removable tank cover 38. In its area adjacent the rear side 20 the frame 12 is shaped as a cleaning liquid tank 40 which is likewise accessible from the upper side 16 and in this area has a filler opening 42.

The central area of the frame 12 in longitudinal direction is designed as a drive receiving means 44 which is accessible from the underside 14 and is separated from the tank receiving means 36 by means of a front intermediate wall 46 and from the cleaning liquid tank 40 by means of a rear intermediate wall 48.

The drive receiving means 44 accommodates a drive unit 50 which is encapsulated in a housing 52 and comprises a suction unit 54 as well as a pump 56. The interior of the housing 52 is accessible via a housing cover 104 held on the underside 14 of the frame 12. The pump 56 is illustrated, in particular, in FIGS. 3 and 4. It communicates with the cleaning liquid tank 40 via a supply tube 58 and with a pressure connection 62 which is of a nipple-shaped design and held on the front side 18 via a pressure tube 60.

The suction unit 54 comprises a suction turbine 64 which is placed on an electric motor 66. The suction turbine 64 is in flow communication, on the one hand, with the tank receiving means 34 via a suction opening 68 arranged in the front intermediate wall 46. On the other hand, the suction turbine 64 is in flow communication with an outlet opening 69 arranged in the housing cover 104.

On its side facing away from the suction turbine 64, a ventilating fan 78 is placed on the electric motor 66 and this fan is in flow communication with a cooling air opening 82 arranged on the underside 14 of the frame 12 via a cooling air channel 80 extending within the housing 52 essentially in a vertical direction. With the aid of the ventilating fan 78 cooling air can be drawn in from the surroundings for cooling the electric motor 66. The cooling air is guided radially outwards at the level of the electric motor 66. For this purpose, the housing 52 of the drive unit 50 has blow-out openings 72 at the level of the electric motor 66. This is illustrated in FIG. 3. The blow-out openings 72 open into an intermediate space 74 which surrounds the housing 52 of the drive unit 50 in a semicircular shape within the drive receiving means 44. The inner walls 28 of the frame 12 have outlet slots 76 at the level of the blow-out openings 72, and in the area of the underside 14 of the frame 12 outlet openings 70 are formed in the inner walls 28. Proceeding from the electric motor 66, a flow connection thus exists to the outlet openings 70 via the blow-out openings 72, the intermediate space 74 and the outlet slots 76.

A short suction connection 84 is arranged above the pressure connection 62 on the front side 18 of the frame 12 and connected to this within the tank receiving means 34 is a suction pipe 86 which is designed in two parts and the end area of which facing away from the short suction connection 84 is surrounded by the tank cover 38 which is of a dome-shaped design in this area and forms a separating wall 88.

In its central area not only in longitudinal direction but also in transverse direction the frame 12 has on its upper side 16 a handle 90 for carrying the cleaning device 10, and two switches 92 and 94 are arranged laterally next to the handle 90 on the upper side 16 for switching the suction unit 54 and the pump 56, respectively, on and off.

During operation of the cleaning device 10 cleaning liquid filled into the cleaning liquid tank 40 is conveyed by means of the pump 56 via the supply tube 58, the pressure tube 60 and the pressure connection 62 as well as via a pressure line, which is known per se, can be connected to the pressure connection 62 and is not illustrated in the drawings, to a spray nozzle likewise not illustrated in the drawings, with the aid of which the cleaning liquid can be sprayed onto a surface to be cleaned. Subsequently, the sprayed cleaning liquid is drawn into the dirty liquid tank 36 together with the dissolved dirt via a suction line, which is known per se, is likewise not illustrated in the drawings and can be mounted onto the short suction connection 84, as well as via the suction pipe 86 and the separating wall 88. For this purpose, the tank receiving means 34 is, as already explained, in flow communication with the suction unit 54 via the suction opening 68 and is acted upon by the suction unit 54 with underpressure.

Under the influence of the suction unit 54, a mixture of dirty liquid and air is drawn into the short suction connection 84 and, subsequently thereto, into the suction pipe 86. The dirty liquid drawn in impinges on the separating wall 88 of the tank cover 38 due to its inertia whereas the air drawn in flows around the separating wall 88 and is drawn into the area of the suction unit 54 via the suction opening 68 and a sealing lip 96 adjoining thereto and, subsequently, as already explained, is discharged to the surrounding atmosphere via the outlet opening 69. The flow connection from the suction turbine 64 to the outlet opening 69 is brought about via a sound-insulating space 71 which is adjacent to the housing cover 104, in which the flow of air is deflected and which can accommodate a sound-insulation material. The dirty liquid impinging on the separating wall 88 drips into the dirty liquid tank 36 on account of the dome-shaped design of the separating wall 88.

If the drive unit 50 is to be removed for maintenance and/or repair purposes, this is possible in a simple manner due to the fact that four retaining screws 98 are released on the underside 14 of the frame 12. Subsequently, the housing 52 can be removed together with the suction unit 54 and the pump 56 of the drive receiving means 44. If the drive unit 50 is to be released completely from the frame 12 of the cleaning device 10, it is merely necessary to release the connection of the pump 56 with the supply tube 58 as well as the pressure tube 60, which is customarily designed in the form of a nipple-sleeve connection, as well as a releasable electrical connection which is known per se and not illustrated in the drawings, for example, a plug-in coupling between the switches 92 and the suction unit 54 and the pump 56, respectively.

The drive unit 50 can thus also be removed from the frame 12 at any time by a lay person and, for example, be replaced by a new drive unit.

If only the pump 56 is to be removed instead of the entire drive unit 50, this may be brought about in a simple manner due to the fact that only two retaining screws 98 are released as well as, in addition, two connecting screws 100 since, as a result, a pump chamber 102 of the housing 52 is accessible from the underside 14 of the frame 12 without it being necessary for this purpose to remove the entire drive unit 50 of the drive receiving means 44. For this purpose, the housing cover 104 closing the housing 52 on the underside 14 of the frame 12 is designed in two parts and comprises a pump chamber cover 106 covering the pump chamber 102 as well as a suction chamber cover 108 adjoining this laterally. The pump chamber cover 106 is held on the suction chamber cover 108 by means of the connecting screws 100. If all four retaining screws 98 are released, the entire drive unit 50 of the drive receiving means 44 can be removed. If, instead, the two connecting screws 100 as well as the two retaining screws 98 arranged adjacent to them are released, the pump chamber cover 106 can be removed and the pump 56 taken out of the pump chamber 12.

The casing of the drive unit in the separate housing 52, which can be introduced into the drive receiving means 44 in the form of an insert, results, on the one hand, in a lay person also being able to remove the drive unit 50. On the other hand, the mounting of the suction unit 54 and the pump 56 on the separate housing 52 causes a considerable dampening of the noises during operation and so the inventive cleaning device 10 is particularly low in noise. Since a flame-resistant or noninflammable plastic is used as material for the housing 52, the inventive cleaning device 10 has, in addition, a high degree of operational safety.

What is claimed is:

1. A cleaning device comprising:

a cleaning liquid tank and a dirty liquid tank;

a pump in flow communication with the cleaning liquid tank for spraying a surface to be cleaned; and a suction unit for receiving the sprayed cleaning liquid and transferring it into the dirty liquid tank;

wherein:

the pump and the suction unit are held in a separate housing adapted to be introduced into a frame of the cleaning device in the form of an insert, said frame has a respective access opening on one side for the cleaning liquid tank and the dirty liquid tank, and the housing accommodating the pump and the suction unit is adapted to be introduced into the frame on the underside of the frame facing away from the access openings.

2. A cleaning device as defined in claim 1, wherein the housing forms a flame-resistant plastic casing for the pump and the suction unit.

3. A cleaning device as defined in claim 2, wherein the housing accommodating the pump and the suction unit is releasably connectable to the frame.

4. A cleaning device as defined in claim 1, wherein the housing accommodating the pump and the suction unit is releasably connectable to the frame.

5. A cleaning device as defined in claim 1, wherein the housing forms a non-inflammable plastic casing for the pump and the suction unit.

6. A cleaning device as defined in claim 1, wherein the housing comprises a suction chamber for accommodating the suction unit as well as a pump chamber for accommodating the pump.

7. A cleaning device as defined in claim 6, wherein the pump chamber is accessible independently of the suction chamber.

8. A cleaning device as defined claim 6, wherein the suction unit is in flow communication with the dirty liquid tank via a suction opening and with the surroundings via an outlet opening arranged on the underside of the frame.

9. A cleaning device as defined claim 1, wherein the suction unit is in flow communication with the dirty liquid tank via a suction opening and with the surroundings via an outlet opening arranged on the underside of the frame.

10. A cleaning device as defined in claim 9, wherein the flow communication between the suction unit and the outlet opening has a deflection for a flow of air blown out from the suction unit.

11. A cleaning device as defined in claim 9, wherein the flow communication between suction unit and outlet opening is brought about via a sound-insulating space.

12. A cleaning device as defined in claim 1, wherein:

the suction unit comprises a ventilating fan for cooling a drive motor of the suction unit, and the fan is in flow communication with a cooling air opening arranged on the underside of the frame via a cooling air channel.

* * * * *